US005113813A

United States Patent [19]

Rosa

[11] Patent Number: 5,113,813

[45] Date of Patent: May 19, 1992

[54] VARIABLE TIMING SYSTEM, PARTICULARLY FOR AN INTERNAL COMBUSTION ENGINE

[75] Inventor: Riccardo Rosa, Maranello, Italy

[73] Assignee: Ferrari S.p.A., Via Emilia Est., Italy

[21] Appl. No.: 655,503

[22] Filed: Feb. 15, 1991

[30] Foreign Application Priority Data

Feb. 16, 1990 [IT] Italy ..... 67118 A/90

[51] Int. Cl.[5] ..... F01L 1/34

[52] U.S. Cl. ..... 123/90.16; 123/90.17

[58] Field of Search ..... 123/90.15, 90.16, 90.17, 123/90.39

[56] References Cited

U.S. PATENT DOCUMENTS

| | | | |
|---|---|---|---|
| 4,151,817 | 5/1979 | Mueller | 123/90.16 |
| 4,726,332 | 2/1988 | Nishimura et al. | 123/90.16 |
| 4,768,467 | 9/1988 | Yamada et al. | 123/90.16 |
| 4,771,742 | 9/1988 | Nelson et al. | 123/90.15 |
| 4,844,023 | 7/1989 | Konno et al. | 123/90.16 |
| 4,848,180 | 7/1989 | Mills | 123/90.39 |

FOREIGN PATENT DOCUMENTS

| | | | |
|---|---|---|---|
| 0186341 | 2/1986 | European Pat. Off. . | |
| 2417637 | 9/1979 | France . | |
| 44713 | 3/1982 | Japan | 123/90.15 |

*Primary Examiner*—David A. Okonsky
*Assistant Examiner*—Weilun Lo
*Attorney, Agent, or Firm*—Shlesinger, Arkwright & Garvey

[57] ABSTRACT

A variable timing system for an internal combustion engine, whereby at least one valve is controlled by a cam via the interposition of a rocker arm. The cam presents a first and second profile formed side by side and providing for different lift/rotation strategies, and the rocker arm consists of two side by side, longitudinal elements connected together, a first of which cooperates permanently with the first cam profile, and a second of which corresponds with the second cam profile and cooperates with means whereby it is set selectively to a first position, wherein the second element of the rocker arm cooperates with the second cam profile, and a second position wherein the second element of the rocker arm is detached from the cam.

7 Claims, 2 Drawing Sheets

Fig. 2
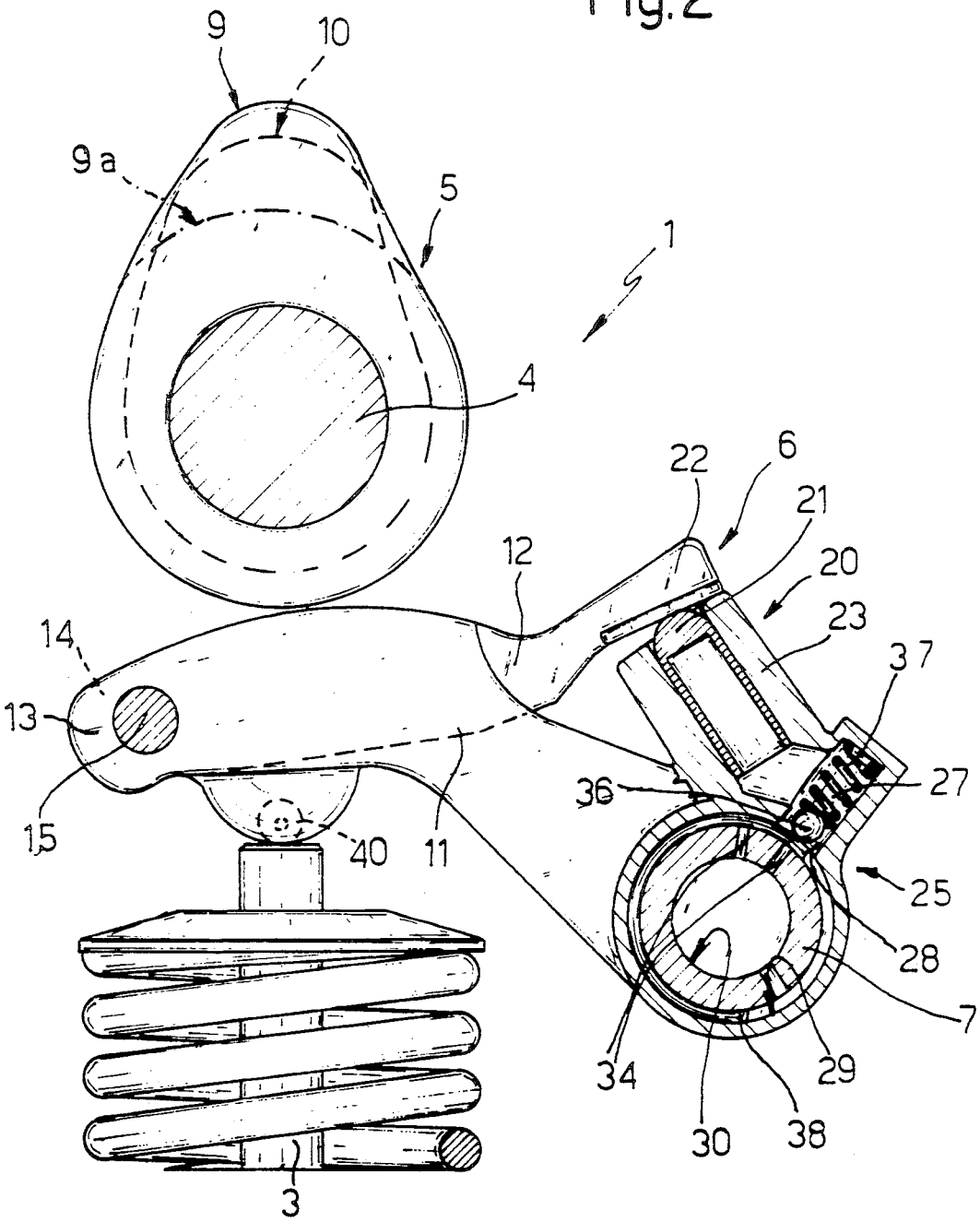
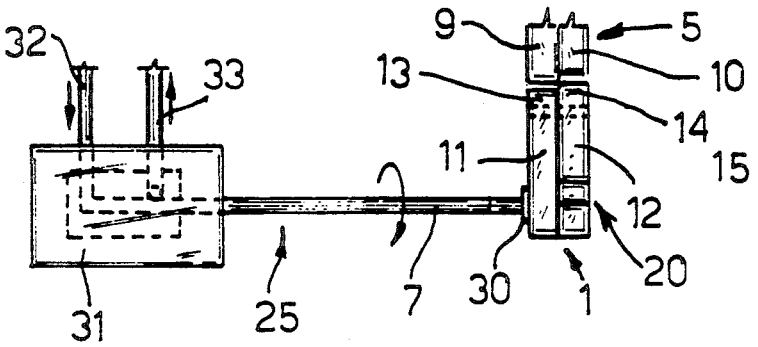
Fig. 3

VARIABLE TIMING SYSTEM, PARTICULARLY FOR AN INTERNAL COMBUSTION ENGINE

BACKGROUND OF THE INVENTION

The present invention relates to a timing system for regulating, via respective camshaft-controlled valves, fluid input and output from one or more cylinders of an engine and/or machine. In particular, the present invention relates to a timing system for varying as required, with the engine or machine running, the lift/rotation strategy whereby the valves are controlled by the cams.

An appropriate way of improving efficiency of internal combustion engines, particularly high-performance engines of sports cars or so-called touring cars, is to vary, according to engine speed/power output/torque, the lift/rotation strategy whereby the cams control the opening/closing cycle of the supply/exhaust valves on the engine. Said lift/rotation strategy is normally imposed by the shape of the lateral cam profile which, when the cam is rotated, gradually cooperates directly or indirectly (via the interposition of rocker arms) with a respective valve stem for determining valve opening/-closing speed and acceleration. Variable timing systems have therefore been devised: in the most common type, the cam controlling one or a series of valves is defined by a complex lateral surface, the profile of which varies not only angularly but also axially, so that axial displacement of the cam in relation to the valve provides for varying, in controlled manner, the lift/rotation strategy governing the valve itself. Such a system involves two drawbacks: firstly, it requires complex design cams which are difficult and expensive to produce; and, secondly, it results in axial thrust on the camshaft, in that the axial profile of the cam is arranged obliquely in relation to the valve stem. French Patent n.2.570.123 relates to a variable timing system whereby a single-profile cam controls the valve via a rocker arm having two differently shaped sections. The rocker arm is supported on a mobile arm whereby the cam cooperates selectively with one or other of the differently shaped sections on the rocker arm. Such a system also involves two drawbacks: firstly, the mobile arm supporting the rocker arm is structurally unsatisfactory; and, secondly, the lift/rotation strategy controlling the valve no longer depends solely on the shape of the cam, but also on that of the rocker arm, thus resulting in serious complications both at design and manufacturing level.

SUMMARY OF THE INVENTION

The aim of the present invention is to provide a variable timing system, particularly for high-performance internal combustion engines, which is structurally satisfactory and straightforward to produce; wherein the valvelift/cam rotation strategy depends solely on the cam profile/s; and which provides for eliminating lateral thrust on the camshaft.

With this aim in view, according to the present invention, there is provided a variable timing system, particularly for an internal combustion engine, wherein at least one valve is controlled by a cam via the interposition of a rocker arm; characterised by the fact that said cam is defined laterally by a discrete number of different side by side profiles; and by the fact that said rocker arm consists of a number of side by side, longitudinal elements connected together and equal to the number of different cam profiles; each said longitudinal element of said rocker arm being designed to cooperate with a respective cam profile facing it; and means being provided for selectively displacing said elements of said rocker arm in relation to one another, so as to selectively cause at least one of said elements of said rocker arm to cooperate with the respective cam profile facing it.

BRIEF DESCRIPTION OF THE DRAWINGS

A non-limiting embodiment of the present invention will be described by way of example with reference to the accompanying drawings, in which:

FIGS. 1 and 2 show a schematic, partially section, side view of a timing system in accordance with the present invention in two different operating positions;

FIG. 3 shows a schematic view of a detail on the FIG. 1 and 2 timing system.

DETAILED DESCRIPTION OF THE INVENTION

Figure 1:
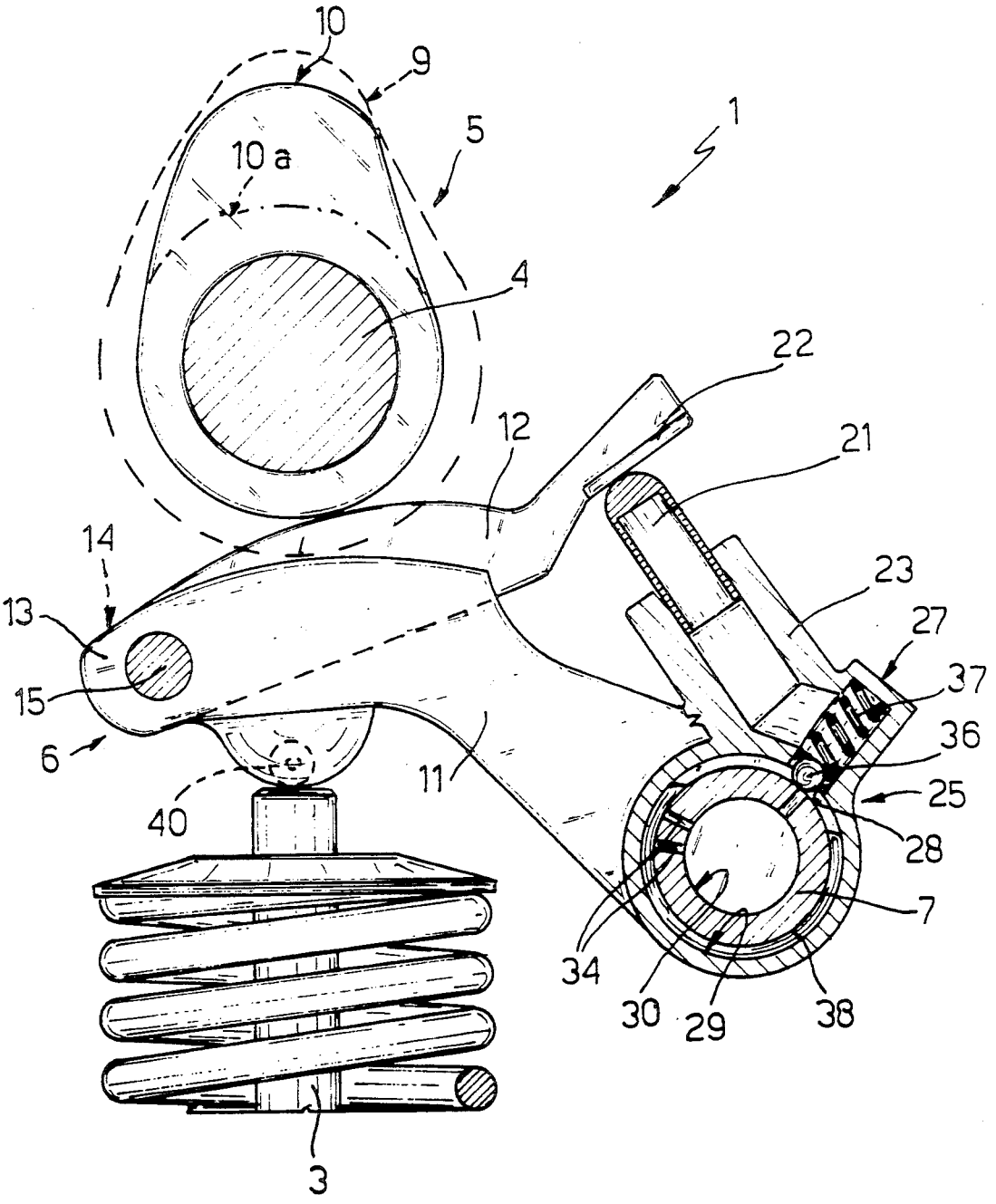

Number 1 in FIGS. 1 and 2 indicates a variable timing system for any known type of engine of machine (not shown). System 1 provides for controlling a known supply or exhaust valve (of which only valve stem 3 is shown) of said engine/machine, so as to vary as required, and at any time during operation of said engine/machine, the strategy governing cyclic operation of said valve stem 3. In the non-limiting example shown, which relates to a timing system for an internal combustion engine, system 1 comprises a camshaft 4 having one or more cams 5 controlling one or more valve stems 3 via the interposition of a rocker arm 6 pivoting on a shaft 7 to the side of and parallel to the rotation axis of cam 5. According to the present invention, cam 5 is defined laterally by a discreet number of different profiles (two in the example shown) formed side by side and numbered 9 and 10 in the accompanying drawings. For a given angular position of cam 5, profile 9 (removed and therefore indicated by the dot-and-dash line in FIG. 1) presents greater lifts (i.e. radial distances of the profile from a base circle 9*a* and 10*a* coaxial with the rotation axis of cam 5) than profile 10, thus enabling it to move valve stem 3 according to a different lift/rotation strategy (i.e. the amount by which valve stem 3 is displaced as a function of the angular position of the cam 5 with which it cooperates) as compared with profile 10. It should be pointed out, however, that the example shown (different lifts and base circle radii) is only one of various possible configurations. Profiles 9 and 10, for example, may present different lifts and the same radii of base circles 9*a* and 10*a*; or the same lifts and different base circle radii; or they may even be asymmetrical. Nevertheless, whether provision is made for two or more different profiles 9 and 10 arranged side by side, a characteristic of the present invention is that, between said different profiles, the axial profile of the lateral wall of cam 5 presents an axial gap (i.e. in the direction of the rotation axis of camshaft 4) so that cam 5 is step-shaped (FIG. 3). This provides for two advantages: firstly, troublefree machining of cam 5, the profiles 9 and 10 of which can be formed as on a normal single-profile cam, with no calculating or special machining required (in other words, cam 5 is comparable to two normal cams, one with profile 9 and the other with profile 10, formed side by side and in one piece); and secondly, the elimination of axial stress on camshaft 4, by virtue of the lateral surface of cam 5 defined by both profiles 9 and 10 being perpendicular to valve stem 3.

In conjunction with the aforementioned characteristic, rocker arm 6 consists of a number of side by side, longitudinal elements connected together and equal to the number of different profiles of cam 5. In the example shown, rocker arm 6 therefore comprises two longitudinal elements 11 and 12 designed to cooperate with facing profiles 9 and 10 of cam 5 respectively. According to the present invention, means are also provided for selectively displacing elements 11 and 12 in relation to each other, so that element 11 cooperates selectively with profile 9 and element 12 with profile 10.

In the example shown, the respective corresponding ends 13 and 14 of elements 11 and 12 are secured together in scissor formation via a transverse hinge pin 15, and only element 11 pivots on shaft 7 so as to normally cooperate with profile 9 and the top of stem 3. Element 12, on the other hand, is supported entirely on element 11, so as to move, in relation to the same, between two positions (FIGS. 2 and 1), in the first of which (FIG. 2), element 12 is detached from cam 5 by virtue of the clearance between element 12 and facing profile 10, and in the second of which (FIG. 1), element 12 cooperates with lateral profile 10. Element 11 also presents an integral hydraulic actuator 20, the mobile element of which, consisting in the example shown of a hollow push rod 21, cooperates with the flat end 22 of element 12 opposite end 14. In particular, hydraulic actuator 20 comprises a hollow body 23 formed in one piece with element 11; push rod 21, which is mounted so as to slide in fluidtight manner inside body 23 and projects from the same in the direction of element 12; and a hydraulic distributor 25 (certain parts of which are show in FIGS. 1 and 2 and others in FIG. 3) for selectively feeding and draining oil (or other fluid) under pressure into/from hollow body 23 for extracting/withdrawing push rod 21.

Hydraulic distributor 25 comprises shaft 7, which is hollow and designed to turn through a given angle about its longitudinal axis; and an automatic non-return valve 27 closing a passage 28 between the inside of hollow body 23 of actuator 20 and the inside of a transverse seat 29 formed through element 11 and housing in fluidtight manner a portion 30 of shaft 7. Via said portion 30, the inside of shaft 7 and a known hydraulic selector 31, e.g. a rotary type fitted integral with shaft 7, seat 29 is selectively connectable to a pressurized oil delivery line 32 and a drain line 33 (FIG. 3) via one or more radial through holes 34 formed on portion 30 of shaft 7 and enabling communication between seat 29 and the inside of shaft 7. For controlling automatic valve 27, which, in the example shown, consists of a ball plug 36 and a spring 37 for normally maintaining valve 27 closed, the outside of portion 30 presents a discontinuous radial projection 38 designed to cooperate with and raise ball 36, against the action of spring 37, and so open valve 27. Rocker arm 6 (in the example shown, element 11) preferably cooperates with valve stem 3 via the interposition of at least one rolling body, e.g. roller 40.

The timing system described above operates as follows. The normal position of elements 11 and 12 is as shown in FIG. 2, wherein element 11 cooperates with profile 9 for accordingly controlling valve stem 3; actuator 20 is idle; element 12 is detached from cam 5 with end 22 contacting body 23 inside which push rod 21 is withdrawn; valve 27 is closed by virtue of shaft 7 being so positioned that projection 38 does not face ball 36, which is thus maintained in the closed position by spring 37; and shaft 7 is so positioned as to maintain selector 31 turned in such a manner as to connect the inside of portion 30 and, consequently seat 29 to drain 33.

For varying operation of stem 3 while cam 5 and stem 3 are actually operating, e.g. to meet the engine supply requirements of specific operating conditions of the vehicle, a known servomechanism (not shown) need simply rotate shaft 7 so as to activate selector 31 and so connect the inside of shaft 7 to pressurized oil delivery line 32. Oil is thus fed into hollow shaft 7 and through holes 34 into seat 29. Rotation of shaft 7 also displaces projection 38 for raising ball 36 and opening valve 27, thus enabling pressurized oil to be fed into actuator 20 for extracting push rod 21 and so parting element 12 in relation to element 11. This brings element 12 into contact with profile 10, which configuration of system 1 is locked by rotating shaft 7 slightly further so as to move projection 38 away from ball 36 and so close valve 27. In this configuration, if, for a given angular position of cam 5, profile 10 provides for greater lifts than profile 9 (calculated as a function of base circle **9*a* of profile 9), profile 10 will predominate and stem 3 be operated according to the strategy imposed by profile 10 instead of profile 9. By appropriately selecting profiles 9 and 10 and the lifts in relation to base circles 9*a* and 10*a*, stem 3 may also of course be operated according to a complex strategy imposed partly by profile 9 and partly by profile 10, precedence being accorded each time to the profile which, for a given angular position, provides for the greatest total lift (the sum of the base circle radius and actual lift). To de-activate profile 10, shaft 7 need simply be restored to the FIG. 2 position wherein valve 27 is opened; the inside of shaft 7 is connected to drain 31; oil is drained from actuator 20 by the thrust between element 12 and cam 5; element 12 is restored to its original position; and stem 3 is again controlled solely by profile 9. If more complex adjustment is required, the same system may of course be used for operating additional different profiles of cam 5 via additional parallel elements 12**, each controlled by a respective actuator.

The advantages of the present invention will be clear from the foregoing description. In addition to being cheap and straightforward to produce, assemble and operate, the timing system according to the present invention also presents a compact, satisfactory structure in terms of load distribution, as well as eliminating axial load on the camshaft. Used in conjunction with an electronic control system, it also provides for making even highly complex adjustments. The system described herein is of course only one non-limiting embodiment of the present invention. Provision may be made for a different mechanism for controlling the two rocker arm elements, again hydraulic and/or involving the use of eccentric shafts; or the same rocker arm may control two or more valves (with the same operating strategy) by providing a fork on end 13.

I claim:

1. A variable timing system, particularly for an internal combustion engine, wherein at least one valve is controlled by a cam on a camshaft via the interposition of a rocker arm; characterized in that:

said cam comprises a discrete number of different side by side cam profiles located in the axial direction of the camshaft;

said rocker arm comprises a number of side by side longitudinal elements connected to one another and equal to the number of different cam profiles, each said element being designed to cooperate with a respective said cam profile facing it;

a first of said elements permanently cooperates with a corresponding first of said cam profiles and with said valve, at least one other element being pivotally carried by said first element in scissor formation with respect thereto;

said first element comprises means for selectively displacing said at least one other element between two different operating positions, in a first of which said at least one other element does not cooperate with the cam, and in a second of which said at least one other element cooperates with a respective other cam profile facing it; and, said other cam profiles being shaped in such a manner that they are able to provide a lift greater than the lift provided by said first cam profile in correspondence with at least some angular position thereof.

2. A variable timing system as claimed in claim 1, characterised by the fact that said rocker arm comprises two side by side, longitudinal elements, the respective corresponding ends of which are secured together in scissor formation via a transverse pin; a first of said longitudinal elements pivoting about a fixed point disposed to one side of the cam rotation axis, and cooperating with the stem of said valve; and a second of said longitudinal elements being supported on said first element and moving in relation to the same between two positions, in a first of which said second element is detached from said cam, and in a second of which said second element cooperates with a respective cam profile facing it.

3. A variable timing system as claimed in claim 2, characterised by the fact that said means for relatively displacing said elements of said rocker arm comprise a hydraulic actuator supported on said first element and the mobile element of which cooperates with a second end of said second element of said rocker arm opposite said pin connecting said first and second elements.

4. A variable timing system as claimed in claim 3, characterised by the fact that said hydraulic actuator comprises a hollow body formed in one piece with said first element; a push rod sliding in fluidtight manner inside said hollow body and projecting from the same towards said second element; and a hydraulic distributor for selectively feeding and draining pressurized oil into/from said hollow body.

5. A variable timing system as claimed in claim 4, characterised by the fact that said hydraulic distributor comprises a hollow rotary shaft selectively connectable to a pressurized oil delivery and drain line, and presenting an assembly portion fitted in idle and fluidtight manner with said first element of said rocker arm and having a discontinuous outer radial projection; and an automatic non-return valve closing a passage between the inside of said hollow body of said hydraulic actuator and the inside of a transverse seat located on said first element and housing said assembly portion of said shaft; said assembly portion also presenting at least one radial hole connecting the inside of said shaft to the inside of said seat and enabling the passage of pressurized oil; and said discontinuous radial projection on said assembly portion being designed, subsequent to predetermined rotation of said shaft, to cooperate selectively with an element closing said automatic valve, so as to open said valve against the action of elastic means.

6. A variable timing system as claimed in claim 2, characterised by the fact that said first element of said rocker arm cooperates with said valve stem via the interposition of at least one rolling body.

7. A variable timing system, particularly for an internal combustion engine, wherein at least one valve is controlled by a cam on a camshaft via the interposition of a rocker arm; characterized in that:

said cam comprises a discrete number of different side by side cam profiles located in the axial direction of the camshaft;

said rocker arm comprises a number of side by side longitudinal elements connected to one another and equal to the different cam profiles, each said element being designed to cooperate with a respective cam profile facing it;

a first of said elements cooperates with a corresponding first of said cam profiles and with said valve, at least one other element being pivotally carried by said first element in scissor formation with respect thereto; and, said first element comprises means for selectively displacing said at least one other element between two different operating positions, in a first of which said at least one other element does not cooperate with the cam, and in a second of which said at least one other element cooperates with a respective other cam profile facing it.

* * * * *